United States Patent [19]

Hochholzer

[11] Patent Number: 4,998,089

[45] Date of Patent: Mar. 5, 1991

[54] POTENTIOMETER AND METHOD OF MAKING THE SAME

[75] Inventor: Reinhard Hochholzer, Leonhardstrasse, Fed. Rep. of Germany

[73] Assignee: Wilhelm Ruf KG, Munich, Fed. Rep. of Germany

[21] Appl. No.: 372,812

[22] Filed: Jun. 29, 1989

[30] Foreign Application Priority Data

Jul. 1, 1988 [DE] Fed. Rep. of Germany ..... 3822391

[51] Int. Cl.[5] ..... H01C 10/32

[52] U.S. Cl. ..... 338/162; 338/184

[58] Field of Search ..... 338/162, 163, 164, 174, 338/184, 188; 29/610.1, 613

[56] References Cited

U.S. PATENT DOCUMENTS 4,117,444 9/1978 Hildreth et al. ..... 338/198
4,210,896 7/1980 Van Benthuysen ..... 338/163

FOREIGN PATENT DOCUMENTS 1515560 8/1969 Fed. Rep. of Germany .
1914865 10/1970 Fed. Rep. of Germany .

*Primary Examiner*—C. L. Albrition
*Attorney, Agent, or Firm*—Cushman, Darby & Cushman

[57] ABSTRACT

A potentiometer which is adapted to be produced fully automatically includes a spring support (2) formed in one piece by injection molding of plastic material and given such configuration that it embraces such functional members as the slider spring (3), resistor plate (5), and base plate (6). The casing (1), is also molded in the same working operation. The casing (1) and spring support (2) are interconnected by a sprue lug (7) which is removed by shearing.

8 Claims, 7 Drawing Sheets

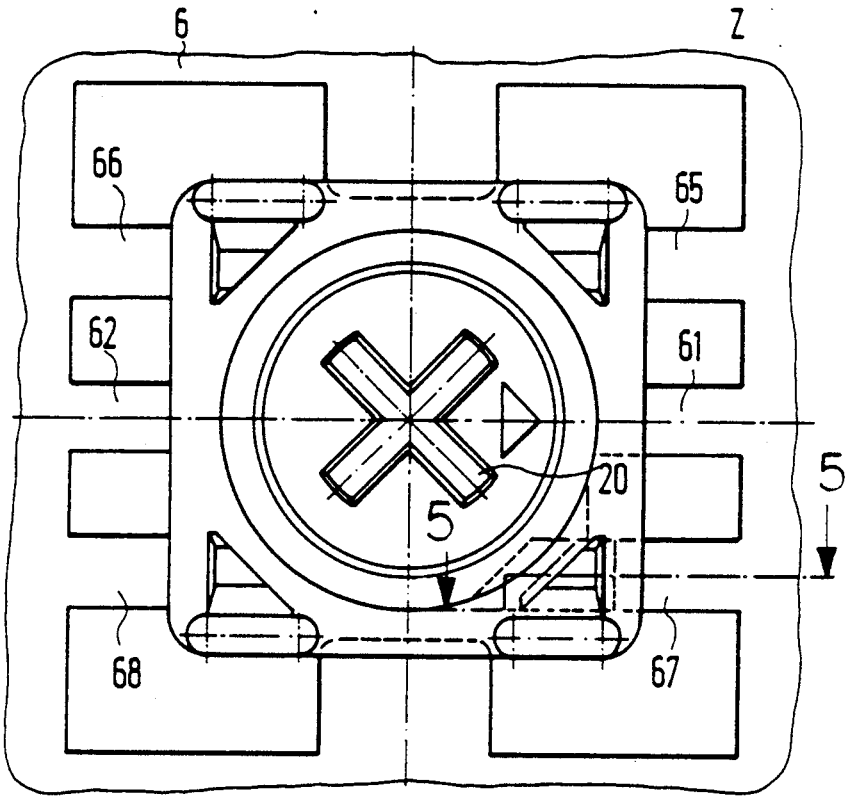
FIG. 4
FIG. 5
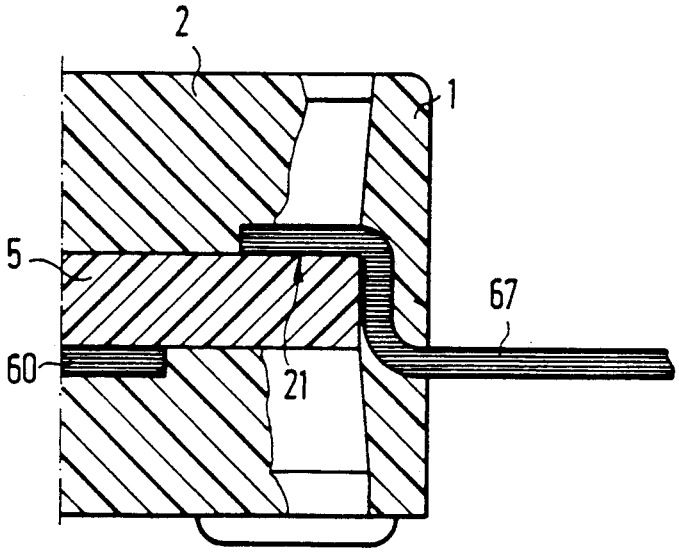

FIG 6b
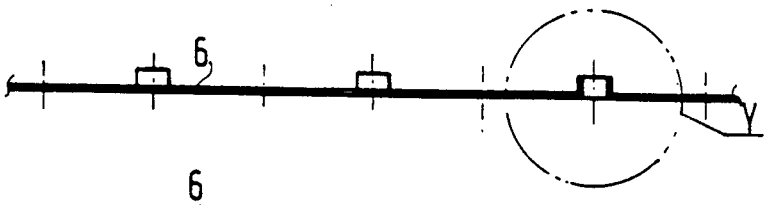
FIG.6a
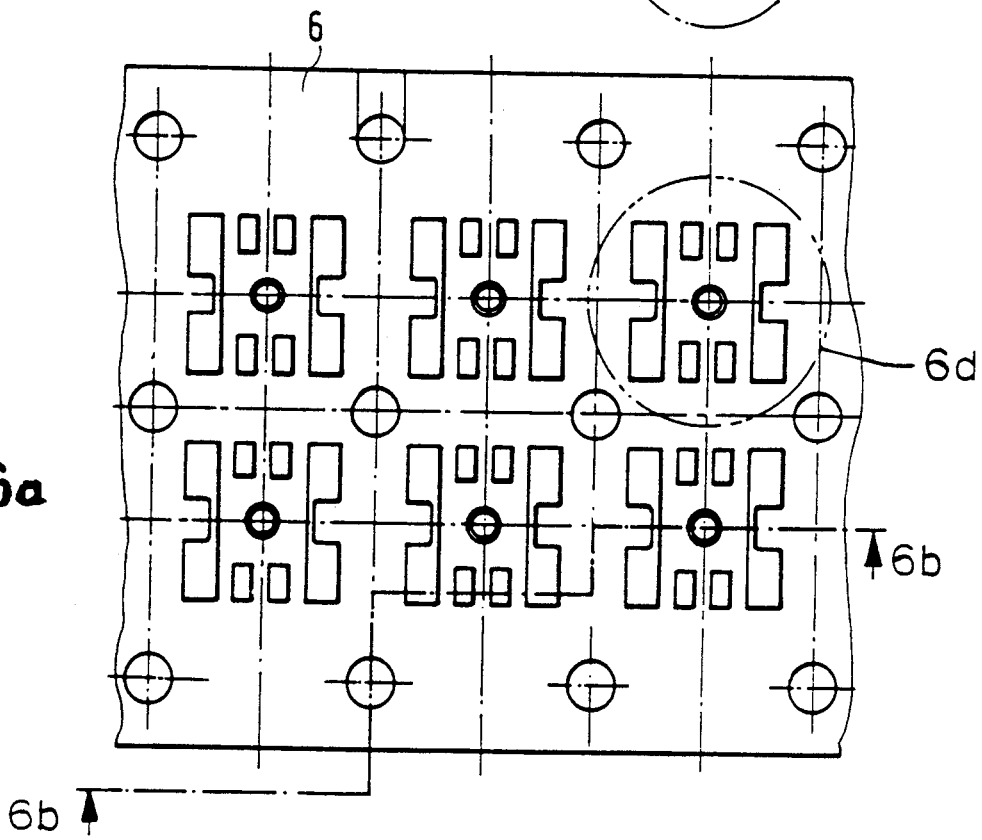
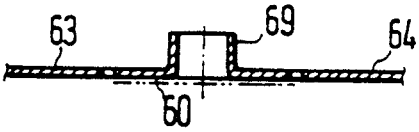
FIG.6c
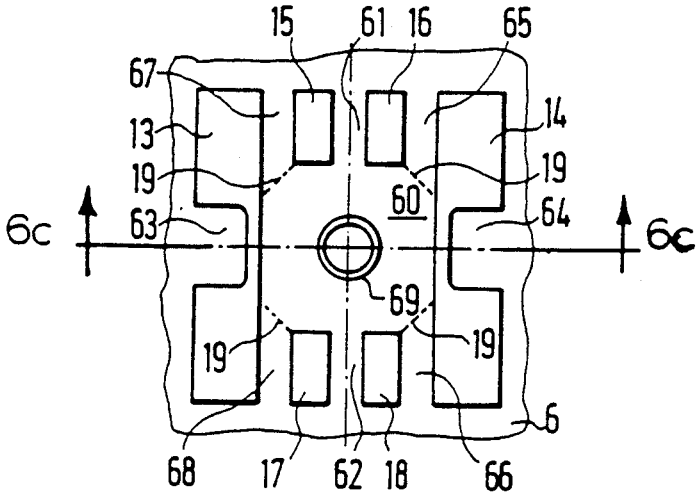
FIG. 6d

POTENTIOMETER AND METHOD OF MAKING THE SAME

FIELD OF THE INVENTION

The instant invention relates to a potentiometer comprising a casing, a resistor plate, a rotary engagement piece, and a slider spring which is non-rotatably held by the engagement piece and in sliding contact with a resistor path on the resistor plate, the casing and the rotary engagement piece being made of a plastic material suitable for injection molding. The invention also relates to a method of producing such a potentiometer.

BACKGROUND OF THE INVENTION

A potentiometer as recited above is known from the applicant's own earlier German patent application P 37 31 328.2 which is not a prior publication. In that case two potentiometer halves were made by injection molding to provide an absolutely liquid-tight potentiometer, both halves of the potentiometer containing respective functional elements of the potentiometer. These two potentiometer halves were welded together by an ultrasonic process.

The potentiometer thus obtained indeed is absolutely impermeable to liquids and lends itself to substantially automatic production. Yet it is rather complicated in structure because of the two halves and expensive to manufacture. In particular, a great many working steps are needed to produce it and that in turn requires expensive means of production.

It is, therefore, an object of the invention to improve the potentiometer of the kind specified initially such that its structure will be simpler, whereby it can be produced fully automatically at a reduced number of working steps.

This object is met, in accordance with the invention, in that the rotary engagement piece is made in one piece and embraces the resistor plate and the slider spring.

Advantageous modifications and further developments of the invention may be gathered from the claim. One claim specifies a manufacturing method for the fully automatic production of the potentiometer according to the invention from band material by a multiple unit procedure.

It is an essential advantage of the invention that the potentiometer can be made fully automatically in an injection molding machine using an injection molding tool which accomplishes not only the injection molding proper but also such additional tasks as the punching out of individual pieces from the tape material and the bending of lugs. Manual handling thus no longer is required in the assembly. Instead, three bands or belts are fed stepwise through the injection molding machine.

The potentiometer obtained by such procedure is of simple structure and very sturdy and can be made completely liquid-tight in a very simple way, namely by inserting a sealing ring. Although the structure and manufacturing process of the potentiometer according to the invention thus clearly are simpler than in the case of the potentiometer according to the earlier patent application P 37 31 328.2 the advantages of the earlier potentiometer still are fully maintained. The following advantages should be mentioned specifically:

sealed against liquids, torques exactly reproducible for the rotational operation of the rotary engagement piece, and sealing function and torque independent of dimensional tolerances of the individual elements and injection mold.

BRIEF DESCRIPTION OF THE DRAWING

The invention will be described further, by way of example, with reference to the accompanying drawings, in which:

FIG. 4 is a plan view looking at the bottom of the potentiometer;

FIG. 5 is a detail sectional view along lines 5—5 of FIG. 4;

FIGS. 6*a*–6*d* show various views of a carrier band during early stages of the manufacturing process according to the present invention;

DESCRIPTION OF THE PREFERRED EMBODIMENTS

Figure 1:
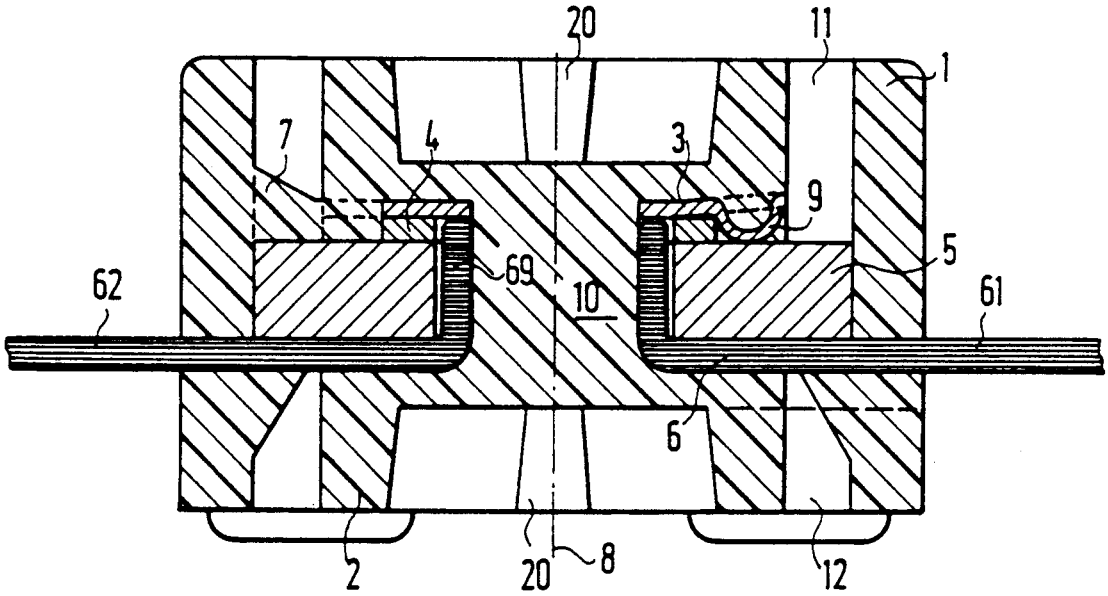
FIG. 1 is a cross sectional elevation of FIG. 2 of the potentiometer according to the invention.

Like parts in the various figures are marked by like reference numerals

In principle, the potentiometer is composed of no more than five parts, namely (1) a plastic member made in one piece by injection molding and being divided functionally into a casing 1 and a rotary engagement member or spring support 2, (2) a contact plate including a resistor path and/or a conductor path, (3) a slider spring 3, (4) a disc 4 which, preferably, is an electrical insulator, and (5) a carrier band 6 from which, later on, several connector lugs (61–68) are severed.

Figure 3:
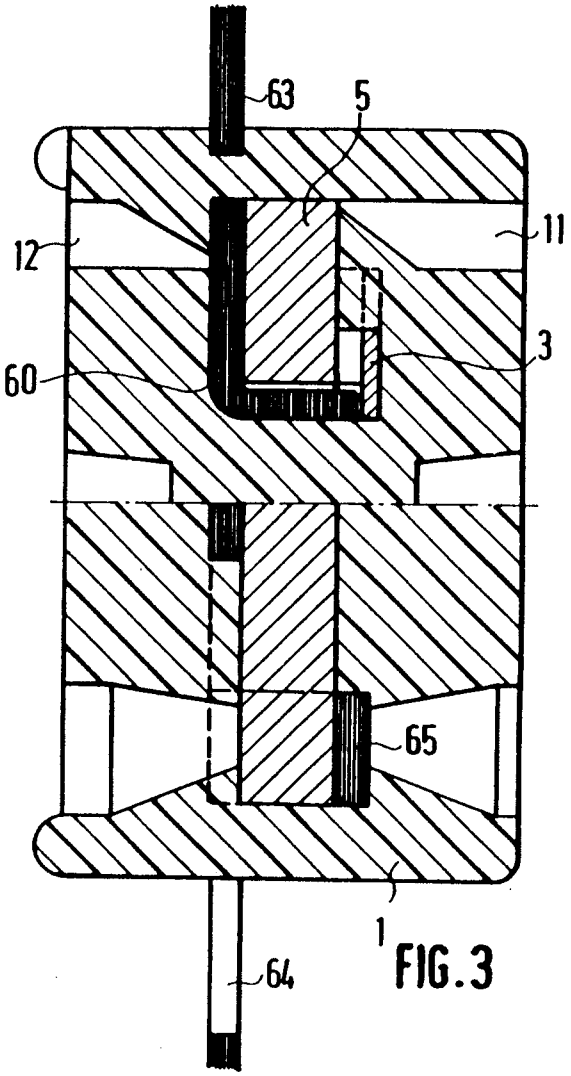
FIG. 3 is a sectional view along lines 3—3 of FIG. 2.
Figure 7A:
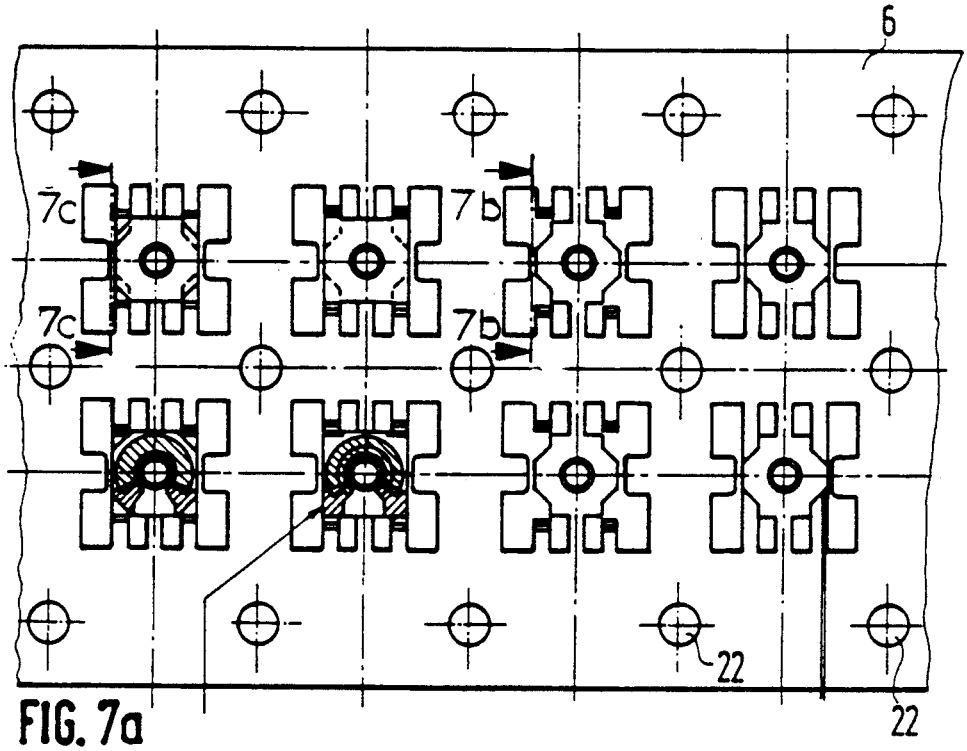
FIGS. 7*a* shows a top plan view of the carrier band illustrating certain manufacturing steps according to the present invention.
Figure 7B:
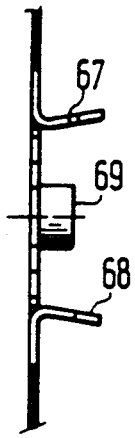
FIG. 7*b* shows a sectional view along line 7*b*—7*b* of FIG. 7*a* illustrating a base plate and lugs during one step of the manufacturing process.
Figure 7C:
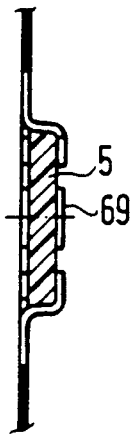
FIG. 7*c* shows a sectional view along line 7*c*—7*c* of FIG. 7*a* illustrating the base plate and lugs during another step of the manufacturing process.
Figure 8A:
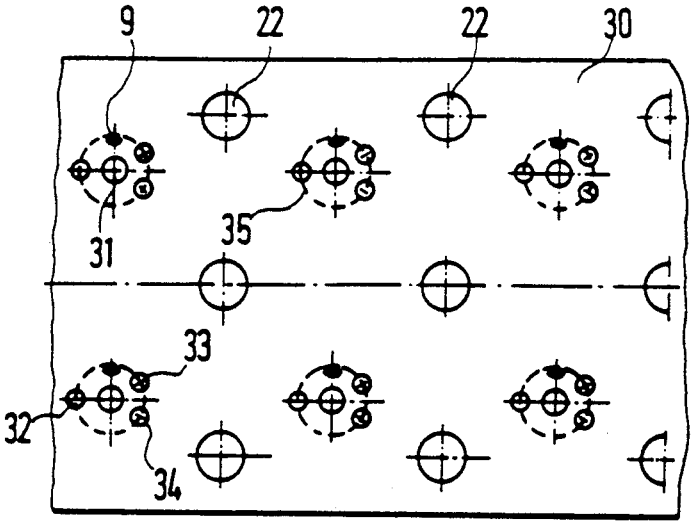
FIG. 8*a* shows a top plan view of the belt holding the slider springs of the present invention.
Figure 8D:
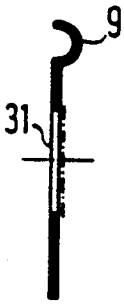
FIGS. 8*b*–8*d* show different views of the slider spring held in the belt of FIG. 8*a;*
Figure 8B:
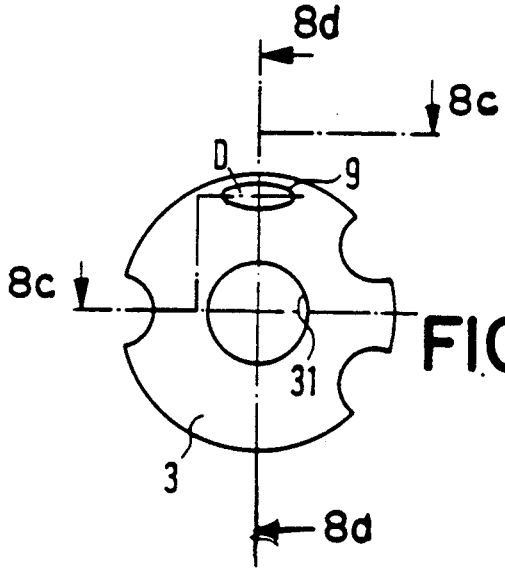
Figure 8C:
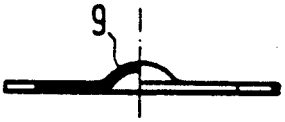
Figure 9A:
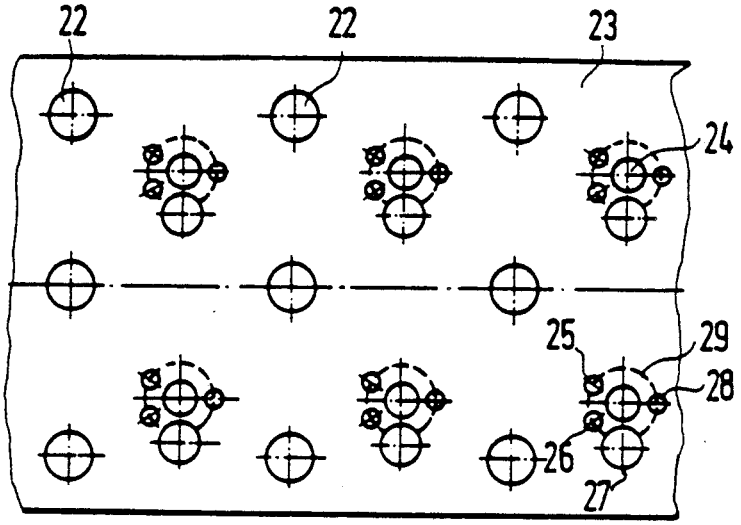
FIG. 9*a* shows a top plan view of the belt holding a disc according to the present invention.
Figure 9B:
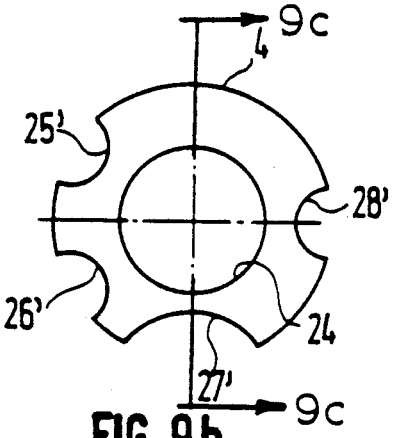
FIGS. 9*b*–9*c* show two views of the disc held in the belt shown in FIG. 9*a*.
Figure 9C:
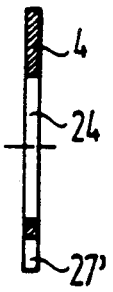

What remains of the carrier band 6 (cf. FIGS. 6*a* and 7*a*) in the finished potentiometer is a base plate 60 (FIG. 3), being the center portion which serves as part of the injection mold during the injection molding. A chimney-like flanged edge 69 is deep drawn from the base plate, centrally with respect to the axis of rotation 8. The resistor plate 5 is pushed over this chimney-like flanged edge 69 which is drawn to such length that it projects above the top of the resistor plate 5. The bottom of the resistor plate 5 rests on the base plate 60 and is centered by its central opening on the chimney-like flanged edge 69. A slider spring 3 engages the upper end surface of the chimney-like flanged edge 69 in good electrical contact, a spherical indentation 9 impressed in the slider spring 3 resting on the resistor path formed on the upper side of the resistor plate 5. A disc 4 is interposed between the top of the resistor plate 5 and the bottom of the slider spring 3, the disc serving as spacer between these members and assuring, during the injection molding process, that no plastic material enters into the area between the resistor path and the slider spring.

The base plate 60, the resistor plate 5, the disc 4, and the slider spring 3 are retained by the casing 1 or the spring support 2. The casing 1 and the spring support 2 are joined integrally by plastics injection molding, these two parts initially still being connected in one piece by a sprue lug 7 which is adapted to be removed by shearing. Turning of the spring support 2 upon completion will shear the sprue lug 7 so that then the spring support is rotatable with respect to the casing, taking along the slider spring which thus slides along the resistor path on the resistor plate 5.

The spring support 2 includes a cylindrical central portion 10 extending through the chimney-like flanged edge 69. At both sides of this central portion the spring support is enlarged radially outwardly, thereby clasping or embracing the members positioned in between The shrinking of the plastics upon curing presses the slider spring 3 against the end surface of the chimney-like flanged edge 69, thereby establishing good electrical contact with an extremely low contact resistance. Furthermore, the shrinking of the plastics also presses the spherical indentation 9 against the surface of the resistor plate 5 so that once again good electrical contact is given.

The bottom of the base plate 60 and the inner side of the chimney-like flanged edge 69 serve as sliding bearing for the spring support 2. In this respect the inside of the chimney-like flanged edge 69 is not critical because some journal clearance will be provided by the shrinkage of the plastics upon curing. More critical is the underside of the base plate 60 which is made as flat and smooth as possible for this reason in the area of contact with the spring support 2.

Circular cavities 11,12 are provided at both sides of the base plate 60 and the resistor plate 5 between the casing 1 and the spring support 2, the sprue lug 7 being positioned in the cavity 11. Complete sealing of the potentiometer is obtained by merely placing a seal in this cavity, and that is done in the easiest way by inserting an O ring seal (not shown). The cavity 12, on the other hand, is not critical because the base plate 60 is positioned at the bottom of this cavity, whereby this cavity is closed inwardly toward the potentiometer so that neither dust nor liquid can enter here.

As seen in the sectional elevation of FIG. 1, the base plate 60 has two connector lugs 61 and 62 projecting outwardly from either side of the casing 1 and serving as the center tap or slider tap of the potentiometer.

The electrical contacting of the resistor path is effected by terminal lugs 65,66,67 and 68 (FIGS. 2 and 3) these lugs forming part of the carrier band 6 from which they are severed after the injection molding process only.

Figure 2:
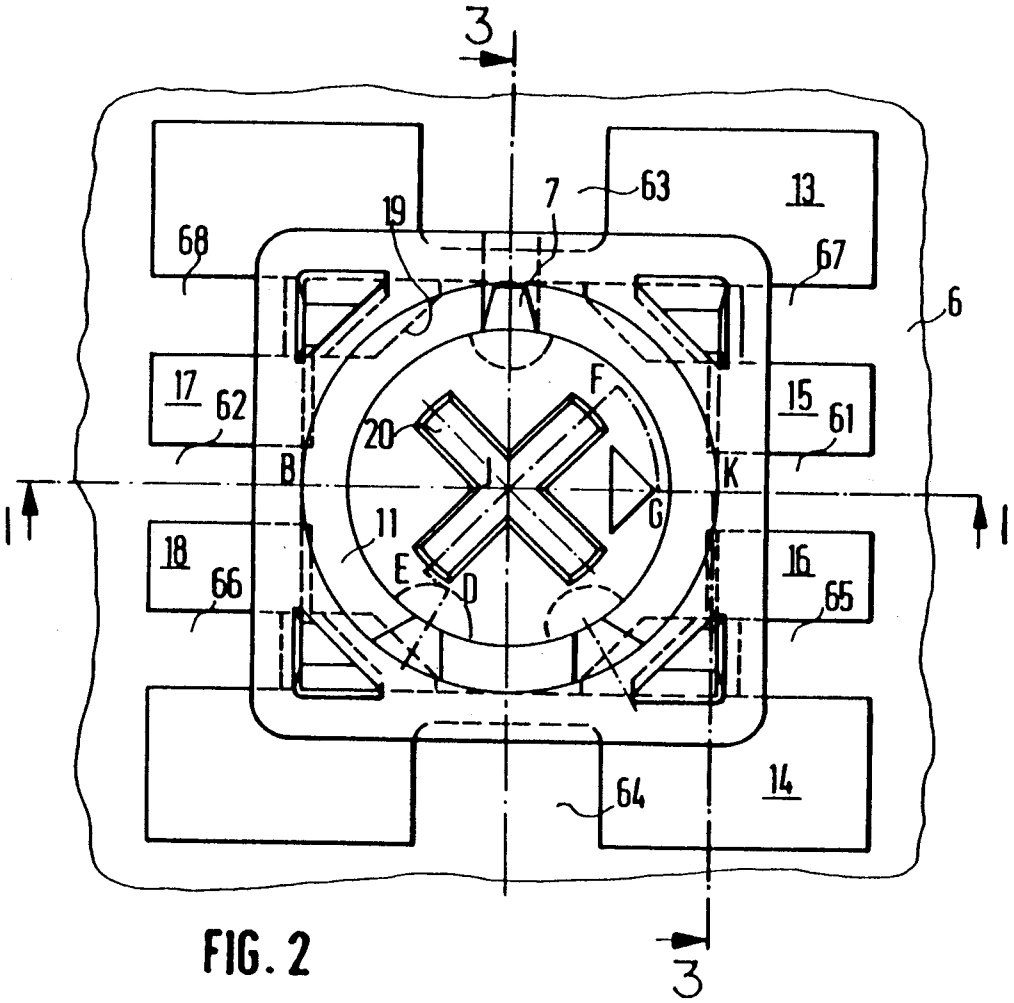
FIG. 2 is a top plan view of the potentiometer.

As best shown in FIGS. 2 and *6a*; the carrier band 6 has a number of breakthroughs 13 to 18 in the area of one base plate (cf. FIG. *6d*) which still is held to the carrier band 6 by lugs 61,62 and 65 to 68. Two further lugs 63 and 64 project into the breakthroughs 13 and 14; they serve as supports during transportation and during the injection molding. Of all the lugs protruding inwardly in comb-like fashion at both sides of the potentiometer (FIG. 2) the two in the middle present the connector lugs 61 and 62 for the center tap. The respective outer pairs of lugs 65 to 68 serve for retention of the resistor plate and for contacting. As shown by the dotted lines 19 in FIG. *6d*, these lugs are severed from the base plate 60 along lines 19 in a first working step. Subsequently the resulting lugs 65,66,67 and 68 are bent upwardly (FIG. *7b*) and then the resistor plate 5 can be put in. This is followed by bending back those parts of the lugs which project above the resistor plate so that they come to lie flat on the resistor plate and enter into contact with contact surfaces of the resistor path (cf. FIGS. 3 and *7c*). These lugs are so long that they project into the range of the resistor plate 5. As may be taken from FIG. 3 with respect to lug 65, the lugs are pressed by the casing 1 against the resistor plate 5 so that upon curing of the plastics considerable contact pressure is generated which assures perfect contacting between the lug and the resistor path which is printed on the resistor plate 5.

As best shown in FIG. *7a*, not all of the lugs must contact the resistor path. It may be sufficient for only two lugs to contact the resistor path, depending on the configuration of the resistor path (see the two lower left presentations in FIG. *7a*), while the other two lugs merely serve for holding the resistor plate 5 in place. Also the lugs 65 to 68 protrude laterally from the casing 1 and may serve as soldering tags or terminal lugs.

It may further be taken from FIGS. 1, 2, and 4 that the spring support 2 includes a cross slot 20 each at the top and at the bottom so as to be able to be turned by a screw driver or the like.

FIG. 5 again clearly shows the contacting between the resistor plate and the connector lugs as well as the contact surface 21 between the resistor path and the connector lug 67.

The manufacturing process will be described in greater detail with reference to FIGS. 6 to 9. The necessary individual components are supplied in the form of carrier bands or belts to the injection molding machine, the bands or belts running in parallel. All the carrier bands have centering apertures 22 by which accurate alignment of the individual members is guaranteed in cooperation with pins arranged in the injection molding tool.

When being fed to the injection molding tool, the carrier band 6 (cf. FIG. *7a*) already has been prepared and has the punched out portions 13 to 18 (FIG. *6a*) as well as the chimney-like flanged edge 69. In a first working step the contact arms are notched by corresponding punches in the stamping tool or in the injection molding tool (cf. lines 19 in FIG. *6d*). This step, therefore, may belong to the preparatory work on the carrier band 6 or may already be part of the working steps realized in the injection molding tool. In the second working step the contact arms are bent out of their plane (cf. FIG. *7b*). In the third working step the resistor plate is inserted. The resistor plates likewise may be supplied by belts. In the fourth working step the contact arms are double bent (cf. FIG. *7c*) so that the resistor plate becomes firmly held.

The second carrier band 23, too, has been prepunched so that it includes a central aperture 24 and four circular apertures 25 to 28 which partly extend into the inside of the circular outer contour 29 of the disc so that finished disc 4 (cf. FIG. *9b*) has four irregularly positioned cut-outs 25' to 28' along its periphery serving to establish form-lock anchorage of the disc in the spring support.

In similar manner also the slider springs 3 (FIG. 8*a*) are held by a third carrier band 30 which also has pre-punched apertures 31 to 34. The diameter of aperture 31 is smaller than that of aperture 24. The diameter of aperture 31 is substantially the same as the inner diameter of the chimney-like flanged edge 69 so that the slider spring 3 may rest on the end surface thereof (cf. FIGS. 1 and 3).

The carrier band 30 furthermore includes spherical indentations 9 formed by deep drawing. These spherical indentations are located in the range of the aperture 27' of disc 4, while the apertures 32,33, and 34 are congruent with the apertures 28,26, and 25, respectively.

In another working step this disc 4 is punched entirely out of the second carrier band 23 along contour 29 and is slid by its central aperture 24 over the portion of the chimney-like flanged edge 69 which projects from the resistor plate 5. In the same manner as with the disc 4, the disc-shaped spring is punched out of the carrier band 30 along contour 35 and positioned inside the injection molding tool such that it will touch the disc 4 and the end surface of the chimney-like flanged edge 69. The punching and positioning of the disc 4 and of the slider spring 3 are accomplished by the closing motion of the injection molding tool by means of a stamp, in one working sequence.

All functional members have been properly positioned in the injection molding machine by these working steps, the injection molding machine is closed, and the plastic material is injected for the casing 1 and the spring support 2.

Of course, the injection molding may produce multiple units at the same time, yielding for instance twelve potentiometers simultaneously . Upon curing of the plastic material (which takes about 12 seconds), the injection mold is opened and a new working sequence begins. In correspondence with the design of the potentiometer, the lugs 65 to 68 (cf. FIG. 2) may have to be severed selectively from the carrier band 6. All that is left to be done before obtaining a potentiometer or trimming resistor capable of proper functioning is to shear the sprue lug 7. That is done by turning the spring support 2. It is obvious that even this step may be taken fully automatically since all the spring supports leave the injection molding machine in the same alignment.

This method consequently is suited for the fully automatic production of potentiometers of very simple structure.

What is claimed is:

1. A method for making a potentiometer, comprising the steps of:

(a) stamping an electrically conductive carrier band to form a plurality of base plates held therein by webs, each said base plate having at least one lug;

(b) forming a chimney-like flanged edge in the carrier band for each said base plate;

(c) bending the lug of each said base plate upwardly at a first location thereof;

(d) inserting a resistor plate between the chimney-like flanged edged and the upwardly bent lug of each said base plate;

(e) bending the lug of each said base plate at a second location thereof such that the resistor plate is retained on the base plate;

(f) aligning a first belt carrying a plurality of discs with the carrier band such that the discs align with the base and resistor plates;

(g) aligning a second belt carrying a plurality of slider springs over the first belt and the carrier band such that the slider springs align with the discs, the base plates and the resistor plates;

(h) stamping the discs out of the first belt and the slider springs out of the second belt onto the respective base plates carried by the carrier band to form a plurality of inner units;

(i) molding a casing and a rotary engagement member about each said inner unit in a single step; and (j) severing the webs of the carrier band to disengage the base plates therefrom, whereby a plurality of soldering tags result from the severed webs.

2. A potentiometer comprising a casing, a resistor plate, a rotary engagement member, and a slider spring, the resistor plate being embraced by the rotary engagement member, the slider spring being non-rotatably held by the rotary engagement member and in sliding contact with a resistor path on the resistor plate, and the casing and the rotary engagement member being made by injection molding in one piece of a plastic material suitable for the injection molding and being interconnected by at least one sprue lug removable by shearing.

3. The potentiometer as claimed in claim 2, further comprising an electrically conductive base plate, having a chimney-like flanged edge extending through an opening in the resistor plate, for establishing electrical contact with the slider spring, wherein a central portion of the rotary engagement member totally fills the interior of the chimney-like flanged edge.

4. The potentiometer as claimed in claim 3, wherein the base plate includes at least one connector lug which is integrally connected thereto and projects laterally out of the rotary engagement member and the casing.

5. The potentiometer as claimed in claim 3 further comprising a disc arranged between the resistor plate and the slider spring, wherein the chimney-like flanged edge extends through a central opening in the disc.

6. The potentiometer as claimed in one of claims 2 to 5, wherein the slider spring is anchored in form lock in the rotary engagement member.

7. The potentiometer as claimed in claim 5, wherein the disc is anchored in form lock in the rotary engagement member.

8. The potentiometer as claimed in one of claims 3 to 7, wherein the resistor plate is retained on the base plate by connector lugs which are connected integrally to the base plate, and wherein the contact lugs are surrounded in part by the plastics of the casing.

* * * * *